United States Patent [19]

Fujita

[11] Patent Number: 4,941,444

[45] Date of Patent: Jul. 17, 1990

[54] ENGINE CONTROL APPARATUS

[75] Inventor: Nagahisa Fujita, Hiroshima, Japan

[73] Assignee: Mazda Motor Company, Hiroshima, Japan

[21] Appl. No.: 313,179

[22] Filed: Feb. 21, 1989

[30] Foreign Application Priority Data

Feb. 26, 1988 [JP] Japan ..... 63-45475
Feb. 26, 1988 [JP] Japan ..... 63-45476

[51] Int. Cl.[5] ..... F02D 11/10
[52] U.S. Cl. ..... 123/399; 123/361
[58] Field of Search ..... 123/352, 361, 399, 436, 123/494

[56] References Cited

U.S. PATENT DOCUMENTS 4,515,126 5/1985 Kessler ..... 123/399 X
4,543,933 10/1985 Kessler et al. ..... 123/399 X
4,569,320 2/1986 Collonia ..... 123/399
4,635,601 1/1987 Cornelius ..... 123/436 X

FOREIGN PATENT DOCUMENTS 164629 8/1985 Japan ..... 123/399
60-198343A 10/1985 Japan .

*Primary Examiner*—Tony M. Argenbright
*Attorney, Agent, or Firm*—Staas & Halsey

[57] ABSTRACT

An engine control apparatus executes feedback control on the basis of throttle valve position data in order to electronically drive a throttle valve in accordance with an operation of an accelerator pedal. The throttle valve is connected to a motor through a wire. The control apparatus calculates a signal for the feedback control so as to suppress resonance of the throttle valve caused by connection through the wire.

13 Claims, 10 Drawing Sheets

ENGINE CONTROL APPARATUS

BACKGROUND OF THE INVENTION

1. Field of the Invention

The present invention relates to an engine control apparatus for controlling an engine by performing drive control of an engine output adjusting member, such as a throttle valve, through an electrical actuator, such as a DC servo motor. More particularly, the invention relates to an engine control apparatus which can prevent or suppress resonance of an output adjusting member when the drive control is realized by feedback control.

2. Description of the Related Art

In an engine for a vehicle, an output adjusting member, such as a throttle valve, is mechanically coupled to an accelerator pedal through a wire. In the mechanically coupled throttle valve, a throttle position, i.e., a throttle valve opening or a rack position is uniquely determined by a depression amount, i.e., an operation amount of the accelerator pedal. However, in control wherein the accelerator operation amount and the throttle position have a unique relationship, i.e., a one-to-one correspondence, only an output corresponding to a depression amount of the accelerator pedal can be obtained when a high output is required, i.e., in an acceleration state. Therefore, it is difficult to accurately correspond to various travel state requests.

Thus, various proposals have been conventionally made. In these proposals, an accelerator pedal and a throttle valve or the like are coupled through an electrical actuator, drive characteristics of the actuator are varied in accordance with a vehicle travel request from a driver (or operator), and the actuator is operated according to the various characteristics, thereby realizing engine control according to a driver's will. For example, in a vehicle accelerator control apparatus described in Japanese Patent Laid-Open Publication (Kokai) No. 60-198343, the drive characteristics of the actuator are defined as a function between the accelerator operation amount and the throttle valve opening. A plurality of the function characteristics are prepared, one of the characteristics is selected on the basis of an accelerator operation speed, and a target throttle valve opening is determined by the selected function characteristic.

In an engine control apparatus for performing feedback control of a throttle valve using an electrical actuator, e.g., a DC servo motor, a direct drive system is normally employed, i.e., the drive shaft of the motor is directly coupled to the throttle valve. However, when the motor is directly mounted, a mounting position is limited in view of a space factor around the throttle valve, and this cannot be easily achieved. Even if it can be mounted, a heavy article, i.e., the motor acts on an intake manifold as a moment, and causes a problem of durability of the intake manifold. For this reason, use of the direct drive system which leads to a very large or heavy intake system around the throttle valve is preferably avoided.

Thus, the motor is mounted on a vehicle body, and the motor and the throttle valve are linked through a wire, so that the intake system around the throttle valve can be made compact. In this wire link system, since the wire as an intermediate member is interposed between the motor and the throttle valve, feedback control may be performed on the basis of position data of the throttle valve (or position data of the motor), i.e., so-called position feedback control.

However, the present inventor found that when feedback control for driving the throttle valve or the like through the wire was performed, the throttle valve was sometimes resonated. According to the measurement results of the present inventor, an oscillation range of the throttle valve due to resonance reached ±10° in the worst case.

SUMMARY OF THE INVENTION

The present invention has been made in consideration of the above problems. Accordingly, it is an object of the invention to provide an engine control apparatus which controls an engine wherein a drive force of an actuator, such as a motor, is transmitted to an output adjusting member, such as a throttle valve or the like, through a wire while performing feedback control so as to drive the adjusting member, and which apparatus can prevent or suppress resonance of the output adjusting member so as to prevent degradation in operation characteristics due to resonance.

It is another object of the present invention to provide an engine control apparatus which comprises a feedback control system for preventing generation of resonance itself, and to improve adjusting accuracy of an engine output and operation stability of an engine.

It is still another object of the present invention to provide an engine control apparatus which can minimize resonance of an output adjusting member to improve adjusting accuracy of an engine output and operation stability of an engine.

According to the present invention, the engine control apparatus comprises: an output adjusting member for adjusting an engine output; an actuator for driving the output adjusting member through a wire; signal detection means for detecting a signal associated with a present drive position of the adjusting member; conversion means for converting an accelerator operation amount into a signal associated with a target position of the adjusting member; feedback control means for receiving the signal associated with the present drive position and the signal associated with the target position, for calculating a feedback control signal based on these signals, and for outputting the control signal to the actuator so as to move the adjusting member to the target position; and suppressing means for suppressing resonance of the output adjusting member.

According to the present invention, the engine control apparatus having an output adjusting member for adjusting an engine output and an actuator for driving the output adjusting member through a wire, comprises: first position sensor means for detecting an operation position of the actuator; second position sensor means for detecting an operation position of the output adjusting member; target position setting means for setting a target position of the output adjusting member; first arithmetic means for calculating a first control amount on the basis of an output from the first position sensor means and an output from the target position setting means; second arithmetic means for calculating a second control amount on the basis of an output from the second position sensor means and the output from the target position setting means; and feedback control means for calculating a feedback control amount on the basis of the calculated first and second control amounts, and outputting a drive signal according to the calculated feedback amount to the actuator. More specifically, two control systems are independently operated on the basis of first and second position sensor signals from the actuator and the output adjusting member which are coupled through the wire, so as to obtain two, i.e., first and second control amounts These control amounts are superposed to constitute one feedback control as a whole. Thus, control based on the first position sensor signal including little disturbance components and control based on the second position sensor signal close to the adjusting member as a final control object, although including many disturbance components, are superposed to achieve drive control of the adjusting member free from resonance itself.

According to an aspect of the present invention, since proportional control is performed on the basis of the output from the first position sensor, response characteristics of the feedback control system can be improved.

According to another aspect of the present invention, since integral control is performed on the basis of the output from the second position sensor, disturbance components in the second position sensor output can be removed, thus improving control accuracy.

According to still another aspect of the present invention, the output adjusting member comprises a throttle valve of the engine.

According to still another aspect of the present invention, the actuator comprises a DC motor which is driven by a DC current corresponding to the drive signal from the feedback control means.

An engine control apparatus according to the present invention having an output adjusting member for adjusting an engine output and an actuator for driving the output adjusting member through a wire, comprises: signal detection means for detecting a signal associated with a present drive position of the adjusting member; conversion means for converting an accelerator operation amount into a signal associated with a target position of the adjusting member; feedback control means for receiving the signal associated with the present drive position and the signal associated with the target position, calculating a feedback control signal on the basis of these signals, and outputting the control signal to the actuator so as to move the adjusting member to the target position; resonance detection means for detecting a resonance state of the output adjusting member; and control characteristic changing means for, when the resonance detection means detects a resonance state or an oscillation state approximate to the resonance state, changing control characteristics of the feedback control means in a direction of eliminating the resonance state. Therefore, when the resonance does not occur, feedback control of the adjusting member is executed in view of response accuracy. When the resonance occurs, since it is eliminated to a practical level, both improvement of the feedback control and elimination of resonance can be achieved at the same time.

According to still another aspect of the present invention, resonance detection is performed on the basis of the frequency and amplitude of a received control signal.

According to still another aspect of the present invention, the output adjusting member comprises a throttle valve of the engine.

According to still another aspect of the present invention, the actuator comprises a DC motor which is driven by a DC current corresponding to the drive signal from the feedback control means.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 13 is a view for explaining characteristics of a map for detecting a resonance state in the second embodiment;

FIG. 14 is a diagram for explaining a modification of an input signal source in the second embodiment; and FIG. 15 is a flow chart for explaining a modification of the control sequence in the second embodiment.

DETAILED DESCRIPTION OF THE PREFERRED EMBODIMENTS

Two embodiments (first and second embodiments) of the present invention will be described hereinafter with reference to the accompanying drawings. In these embodiments, a throttle valve for a gasoline engine is used as an engine output adjusting member, and a DC servo motor is used as an example of an actuator.

Operational Principle

Figure 1A:
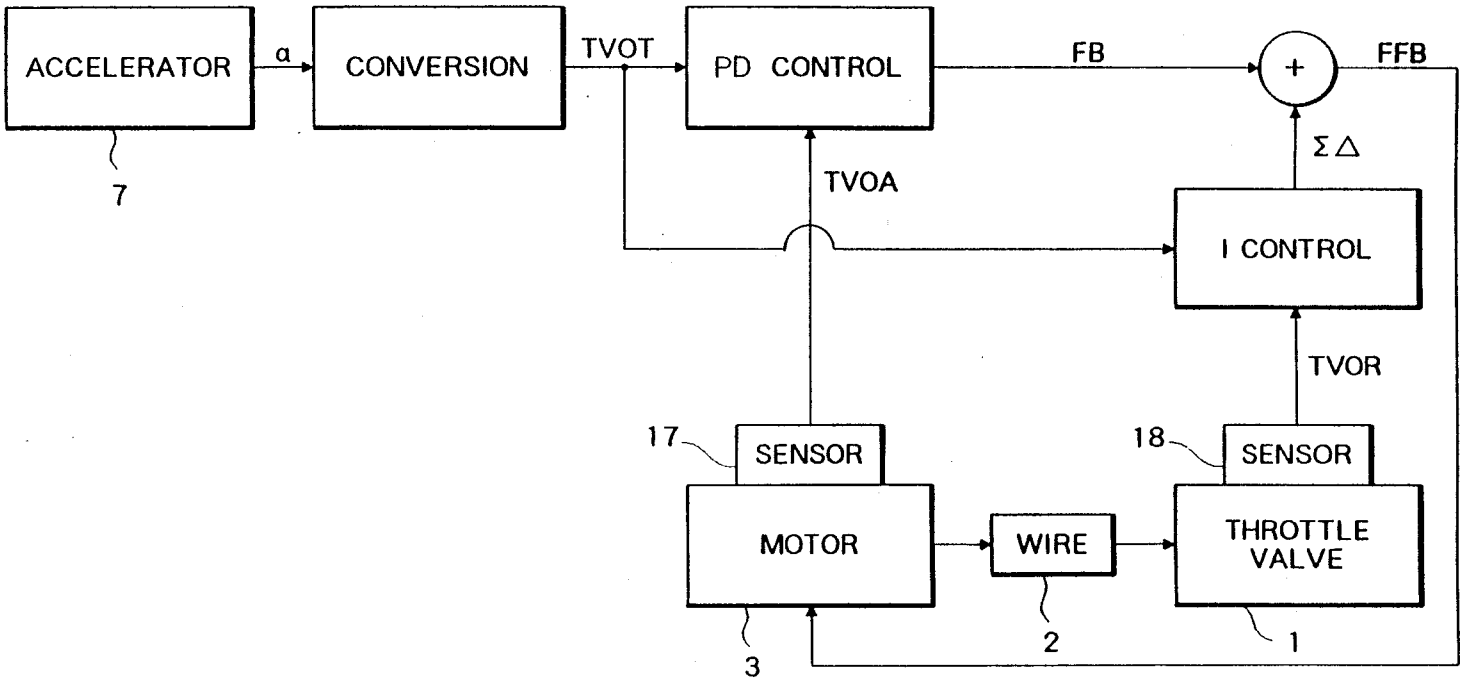
FIG. 1A is a block diagram for explaining the principle of a first embodiment of the present invention.

FIG. 1A shows the operational principle of the first embodiment. In the first embodiment, a DC servo motor 3 is coupled to a throttle valve 1 through a wire 2. The throttle valve 1 is opened/closed by forward/reverse rotation of the motor 3. A sensor 17 for detecting a rotational position of the motor is provided to the motor 3, and a sensor 18 for detecting a valve opening position is provided to the throttle valve 1. An accelerator opening $\alpha$ is converted to a $\delta$ target throttle opening TVOT in accordance with appropriate conversion characteristics, and the target opening TVOT is input to a feedback control system. The feedback control system of the first embodiment includes an independent proportional plus derivative ("PD") control system, and an integral ("I") control system. The PD control system calculates a PD control amount FB on the basis of the target throttle opening TVOT and a motor rotational angular position TVOA. The I control system calculates an I control amount $\Sigma\Delta$ on the basis of the target throttle opening TVOT and the throttle valve opening TVOR. The servo motor 3 is driven by (a current according to) a final control amount FFB determined by the control amounts FB and $\Sigma\Delta$.

The present inventor found a cause of resonance occurring in the throttle valve when the motor and the throttle valve were coupled through the wire. More specifically, as a feedback signal, it is most preferable that an actual position (opening) of the throttle valve 1 is directly detected However, when a servo control arrangement for directly detecting the throttle valve opening is employed, many disturbances caused by the wire enter a servo loop, and the servo system is resonated or causes hunting, resulting in an unstable system. This resonance tendency becomes conspicuous as a servo gain is increased to improve positioning precision. However, if the gain is reduced to prevent resonance, positioning precision cannot be maintained, and the significance of defining the relationship between the accelerator opening and the throttle opening as nonlinear characteristics is lost. A servo loop may be constituted, so that feedback is performed at a drive position of the motor to block a disturbance. However, since this loop is not concerned with an actual throttle valve opening and an error of the wire is undesirably mixed, control accuracy cannot be sufficiently improved In other words, it can be considered that the cause of resonance is to use the throttle opening signal TVOR obtained on the side of the throttle valve through the wire in the feedback control in order to improve control accuracy and shorten response time of the throttle opening.

However, when the arrangement of the first embodiment shown in FIG. 1A is employed, the feedback control system is divided into a loop (I control system) which includes a disturbance factor caused by the wire, and a loop (PD control system) which does not include the disturbance factor. The loop including the disturbance is defined as a loop having an integral term, which rarely causes resonance. To the contrary, the loop which does not include the disturbance is defined as a loop at least having a proportional term and good response characteristics. A disturbance caused by the wire is mixed in the output TVOR from the sensor 18. However, the feedback control by the integral term from the I control system rarely causes resonance or hunting since a change in control amount is relatively small. Since the output TVOR is obtained by directly detecting an actual throttle position, feedback control accuracy by the I system is high. Since the PD control system employs a detection value of the sensor 17 free from the disturbance as a feedback signal, this will not cause resonance or hunting. The response characteristics with respect to a change in target throttle position are assured by feedback control by the proportional and derivative terms of the PD control. Thus, the resonance of the throttle valve can be prevented, and control accuracy of the throttle opening and the response characteristics can be improved at the same time.

Figure 1B:
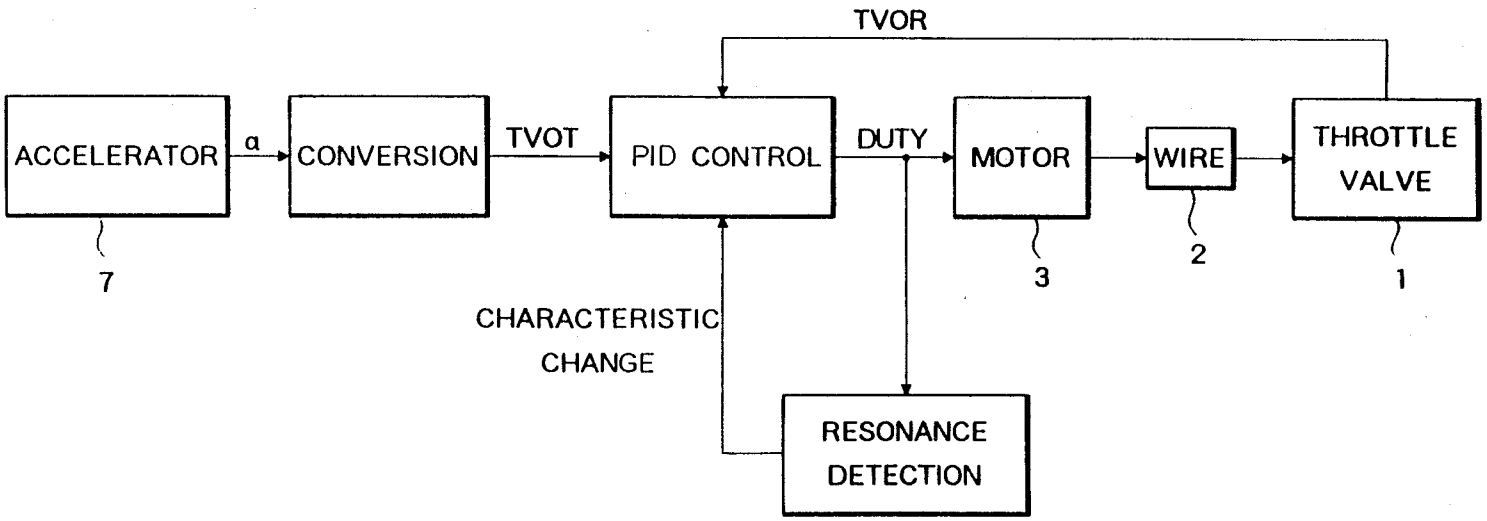
FIG. 1B is a block diagram for explaining the principle of a second embodiment of the present invention.

FIG. 1B shows the operational principle of a second embodiment. In the second embodiment, a duty signal DUTY for the motor 3 is calculated on the basis of the target throttle opening TVOT and an actual throttle opening position TVOR, and the signal DUTY is pulse-width modulated and output to the motor 3, thus performing feedback control (PID control). In this feedback control, a resonance state of the throttle valve 3 is discriminated from the signal DUTY. When the resonance state is detected, the PID control characteristics are changed.

The present inventor found another cause of resonance occurring when the motor and the throttle valve were coupled through the wire. Since the motor is normally driven by duty control, if the frequency of a change in duty value coincides with the frequency of a mechanical system, such as the wire, the control system causes resonance. The resonance is increased by a disturbance caused by the wire or a variation in load due to a hysteresis of the wire. Thus, the control system is set in a resonance system or an oscillation state approximate to the resonance state.

According to the second embodiment shown in FIG. 1B, the PID control system compares the actual opening position TVOR and the target throttle position TVOT, calculates a feedback control signal based on a difference therebetween in accordance with predetermined control characteristics, and outputs the control signal to the motor 3. The motor 3 is operated, and the throttle valve 1 is then driven through the wire 2. When it is determined that the throttle valve 1 is in a resonance state or an oscillation state approximate to the resonance state upon analysis of the signal DUTY, feedback control characteristics are changed in a direction of eliminating the resonance. Thus, an unstable operation of the throttle valve 1 can be suppressed.

In the first embodiment, the feedback control system includes the PD control system and the I control system, so that the resonance itself of the throttle valve 1 can be prevented. However, the control system becomes complicated. In the second embodiment, although oscillation of a given level in an opening/closing operation of the throttle valve is present, the oscillation is suppressed to a practical level, and the control system can be simplified as compared to the first embodiment.

DETAILED DESCRIPTION OF THE FIRST EMBODIMENT

Figure 2:
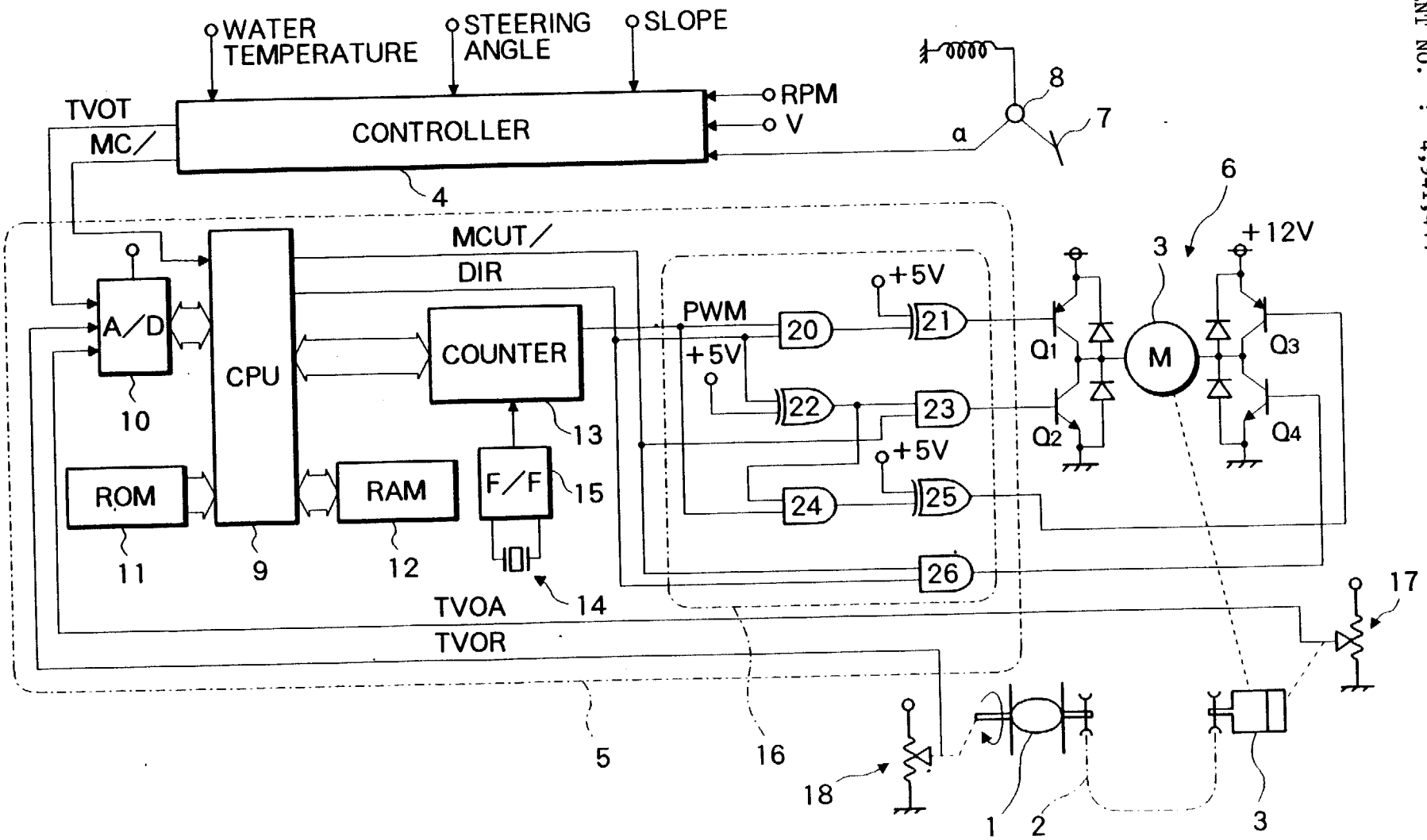
FIG. 2 is a block diagram showing a hardware arrangement of the first embodiment.

FIG. 2 is a block diagram of a detailed hardware arrangement of the control apparatus according to the first embodiment.

In the first embodiment, the servo control system of the motor 3 comprises a throttle controller 4, a servo controller 5, and a driver (servo amplifier) 6.

The throttle controller 4 calculates the target value TVOT (analog value) of a throttle opening on the basis of an output signal $\alpha$ from an accelerator sensor 8, an engine speed signal RPM, vehicle speed signal V, a slope signal, a steering angle signal, a water temperature signal, and the like, and outputs the calculated value to the servo controller 5. The controller 4 discriminates an abnormal state in accordance with an engine speed, and the like, and outputs a motor cut signal MC/ (digital value) to the servo controller 5. Note that symbol "/" of the signal MC/ means "active low". As is well known, the relationship between the accelerator opening and the target opening value TVOT is determined in accordance with characteristics wherein as the opening of the accelerator pedal increases, the throttle opening increases. As will be described later, the motor cut signal MC/ is processed in a CPU 9 to be converted to a signal MCUT/. However, the meaning of the signal MC/ remains the same.

The position sensor 17 for detecting a rotational angular position signal TVOA is attached to the motor 3. The sensor 18 for directly detecting an opening TVOR is attached to the throttle valve 1.

The servo controller 5 comprises a microprocessor (CPU) 9, and an A/D converter 10, a ROM 11 and a RAM 12 which are arranged around the CPU 9. The A/D converter 10 converts the target opening signal TVOT, the motor rotational angular position signal TVOA, and the actual opening signal TVOR of the throttle valve as analog signals into corresponding digital values. Although not shown, the CPU 9 comprises an I/O port, a timer for generating an interruption signal, and a real-time clock (RTC) for holding present time.

The servo controller 5 also includes a counter 13 for pulse-width modulating the duty signal DUTY represented by a digital value. More specifically, the CPU 9 supplies the duty value DUTY representing a motor current value to the counter 13 through a data bus. The counter 13 periodically outputs a pulse signal PWM of logic "1" having a duration corresponding to the value DUTY to a logic circuit 16. The reference clock of the counter 13 is obtained by frequency-dividing a signal from an external quartz oscillator 14 by a flip-flop 15, and its frequency is about 4 MHz. The counter 13 has an 8-bit arrangement. Therefore, when a 4-MHz clock is input, the frequency of the duty cycle of the counter 13 is about 15 kHz, and its period is about 64 $\mu$s. When the CPU 9 sets a new value DUTY in the counter 13, the duty ratio of the signal PWM is changed while maintaining a frequency of about 15 MHz. Note that the counter 13 is an 8-bit counter which can load a preset value from the CPU by data DUTY. When an initial value is set in the counter 13, it increments the initial value in synchronism with the clock (4 MHz). When the 8-bit counter 13 overflows (count value=256), the initial value is automatically set therein again without going through the CPU 9, and the counter 13 restarts the count-up operation. The detailed operation of the counter 13 will be apparent from a description with reference to FIG. 7 later.

The servo controller 5 comprises the logic circuit 16 for receiving three signals PWM, MCUT/, and DIR as input signals. The operation of the driver 6 can be controlled by four outputs from the logic circuit 16.

The driver 6 comprises four transistors $Q_1$, $Q_2$, $Q_3$, and $Q_4$ which are arranged in an H form, so as to allow forward/reverse rotation of the motor 3. When both the first (PNP) transistor $Q_1$ and the fourth (NPN) transistor $Q_4$ are enabled, the motor 3 is rotated in the forward direction to open the throttle valve 1. When both the second (NPN) transistor $Q_2$ and the third (PNP) transistor $Q_3$ are enabled, the motor 3 is rotated in the reverse direction to close the throttle valve 1.

The ROM 11 stores control programs shown in the flow charts to be described later. As will be described in detail later, the CPU 9 compares the output TVOA from the position sensor 17 indicating the motor rotational angular position with the target opening TVOT, and determines a control amount FB of the proportional plus derivative control on the basis of a difference therebetween. The CPU 9 also compares the output TVOR from the sensor 18 representing the throttle valve opening and the target throttle valve opening TVOT and determines a control amount $\Sigma\Delta$ of the integral control on the basis of a difference therebetween. The CPU 9 determines a final feedback control amount FFB as a combination of the control amounts FB and $\Sigma\Delta$, and calculates a value (DUTY) and direction (DIR) of a current which flows through the motor 3 on the basis of the amount FFB. The calculated current value is converted to the 8-bit signal DUTY, and is pulse-width modulated to the signal PWM by the counter 13. The signal PWM is output to the logic circuit 16.

The logic circuit 16 receives the pulse-width modulated duty signal PWM, the current direction signal DIR corresponding to a current direction, and a current cut signal MCUT/ (symbol "/" represents "active low") output from the CPU in correspondence with the motor cut signal from the throttle controller 4. The logic circuit 16 comprises seven logic elements (gates 20 through 26). The four output terminals of the circuit 16 are connected to the bases of the four transistors $Q_1$, $Q_2$, $Q_3$, and $Q_4$ constituting the driver 6.

Figures 3, 7:
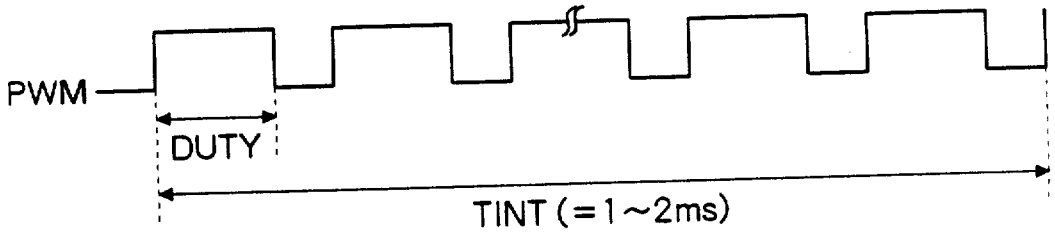
FIG. 3 is a table for explaining an operation of a logic circuit in the first and second embodiments.
FIG. 7 is a chart for explaining duty control of a motor current by a pulse-width modulated signal PWM in the first and second embodiments.

FIG. 3 is a table showing logic states of the transistors ($Q_1$, $Q_2$, $Q_3$, and $Q_4$) in accordance with the values of the three signals (PWM, DIR, and MCUT/).

Referring to the table of FIG. 3, the operation of the logic circuit 16 can be easily understood. The first transistor $Q_1$ is controlled by a logic circuit in which an output from an AND gate 20 for receiving the duty signal and the current direction signal is inverted by an EX-OR gate 21. More specifically, when both the signals PWM and DIR are at HIGH ("1") level, the base potential of the transistor $Q_1$ goes to LOW level, and the transistor is enabled. The fourth transistor $Q_4$ is controlled by the output from an AND gate 26 for receiving the current direction signal DIR and the current cut signal MCUT/. When both the signals are at HIGH level, the base potential of the transistor $Q_4$ goes to HIGH level, and the transistor is enabled. Therefore, as long as the signal MCUT/ is at HIGH level and the current direction signal DIR is at HIGH level, the fourth transistor $Q_4$ is kept ON, and the forward rotation of the motor 3 is exclusively controlled by the signal PWM.

The third transistor $Q_3$ is controlled by a logic circuit in which an output from an AND gate 24 which receives the signal PWM as one input and a signal obtained by inverting the signal DIR by an EX-OR gate 22 as the other input is inverted by an EX-OR gate 25. More specifically, when the signal PWM is at HIGH level and the signal DIR is at LOW level, the base potential of the transistor $Q_3$ goes to LOW level, and the transistor is enabled. The second transistor $Q_2$ is controlled by an output from an AND gate 23 which receives the inverted signal of the signal DIR as one input and the signal MCUT/ as the other input. More specifically, when the signal DIR is at LOW level and the signal MCUT/ is at HIGH level, the base potential of the transistor $Q_2$ goes to HIGH level, and the transistor is enabled. Therefore, as long as the signal MCUT/ is at HIGH level and the signal DIR is at LOW level, the second transistor $Q_2$ is kept ON, and the reverse rotation of the motor is exclusively controlled by the signal PWM.

As described above, when the signal PWM is at HIGH level and the signal MCUT/ is at HIGH level, if the signal DIR is at HIGH level, only the transistors $Q_1$ and $Q_4$ are enabled (state 7 in FIG. 3); and if the signal DIR is at LOW level, only the transistors $Q_2$ and $Q_3$ are enabled (state 5 in FIG. 3). When the signal MCUT/ is at LOW level, the fourth and second transistors $Q_4$ and $Q_2$ are disabled, and no current flows through the motor 3.

For the forward rotation of the motor like in a state 6 in FIG. 3, only the transistor $Q_1$ of the transistors $Q_1$ and $Q_4$ is driven, and no current flows through the motor 3. For the reverse rotation of the motor like in a state 4 in FIG. 3, only the transistor $Q_3$ of the transistors $Q_3$ and $Q_2$ is driven, and no current flows through the motor 3. In the states 4 and 6, since only one transistor is driven, a problem of asynchronism caused by a variation in characteristics of two transistors is not posed, and reliable duty control can be performed. Since the transistors $Q_1$ and $Q_4$ and the transistors $Q_3$ and $Q_2$ are not enabled at the same time, even if the CPU overruns and the logic of the output ports cannot be assured, the driver 6 and the motor 3 can be prevented from being burned due to short-circuiting. Since the drive control of the motor 3 is performed through the logic circuit 16, a software load of the CPU 9 can be reduced.

Figure 5:
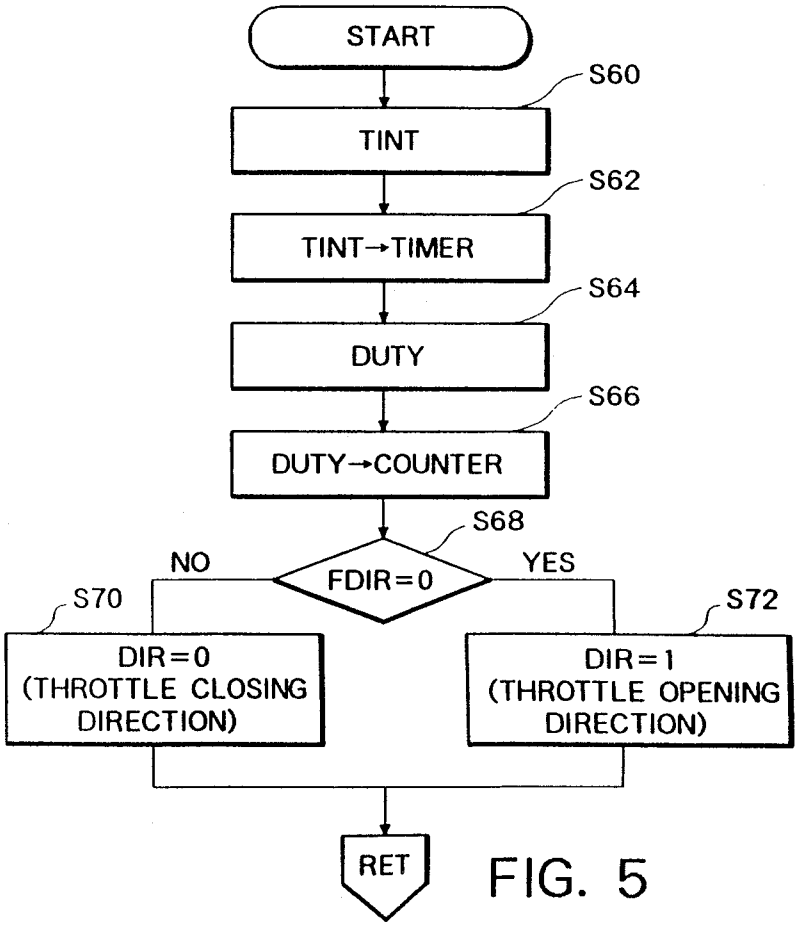
FIG. 5 is a flow chart of an interruption control portion of the control sequence of the first embodiment.
Figure 4:
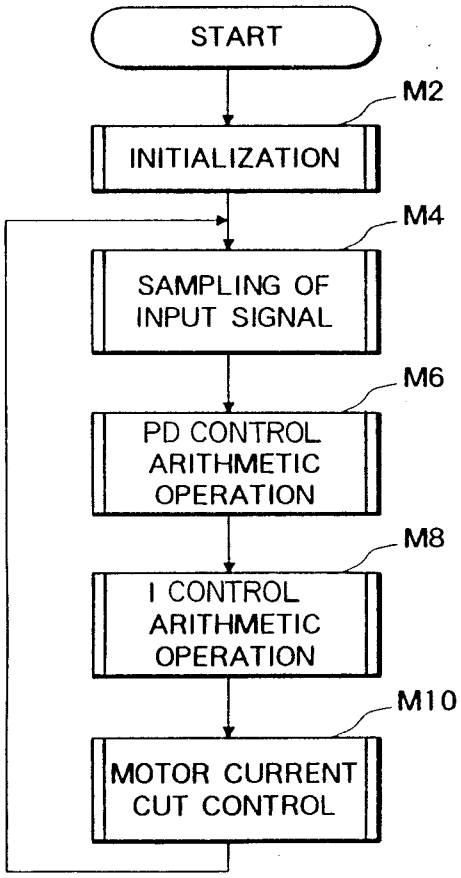
FIG. 4 is a flow chart associated with a main routine portion of a control sequence of the first embodiment.

FIGS. 4 and 5 and FIGS. 6A through 6E are flow charts showing a control sequence for executing the control of the first embodiment. FIG. 4 shows the main routine. The main routine consists of five subroutines, and the subroutines are shown in detail in FIGS. 6A through 6E, respectively. FIG. 5 shows a routine started upon timer interruption. In this control, the signal DUTY is supplied to the counter 13, and the signal PWM is output to the logic circuit 16.

The entire main routine will be described first with reference to FIG. 4. Initialization in step M2 is performed only once after an ignition switch is turned on. Once the initialization is performed, the loop of subroutines, i.e., sampling of input signals (step M4) → arithmetic operation for PD control (step M6) → I control arithmetic operation (step M8) → cut control of motor current (step M10), is repeated. In this loop, the current direction is determined, and whether or not the motor current is cut is determined. In the PD control subroutine, the control amount FB is calculated on the basis of a difference between the motor rotational angular position TVOA and the target opening TVOT in accordance with proportional plus derivative control. In the I control arithmetic subroutine, the control amount $\Sigma\Delta$ is calculated on the basis of a difference between the actual throttle opening TVOR and the target opening TVOT in accordance with integral control. The control amount FB calculated in the PD control arithmetic subroutine is corrected by the control amount $\Sigma\Delta$, and the corrected value is used as the final motor current value FFB. Based on this value FFB, the duty value DUTY corresponding to this current value is calculated. Note that in the I control subroutine, the duty value DUTY is only held as internal data of the CPU 9. In the interruption routine which is started at predetermined time intervals (FIG. 5), the digital value DUTY is output to the counter 13 so as to set the signal PWM at HIGH level and to cause a current to flow through the motor 3.

The subroutines will be described in detail below.

Figure 6A:
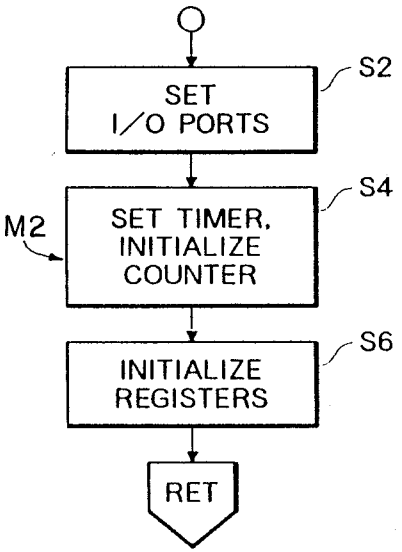
FIGS. 6A through 6E are detailed flow charts of subroutines of the first embodiment.

FIG. 6A shows the initialization subroutine in detail. In step S2, mode setting of the ports (not shown) of the CPU 9 (i.e., whether the ports are used as input or output ports) is performed. The ports include a port for receiving the motor cut signal MC/ from the controller 4, a port for outputting the motor cut signal MCUT/ to the logic circuit 16, a port for outputting the current direction signal DIR, and the like. In step S4, an interruption processing timer (an internal timer of the CPU 9; not shown) and the pulse-width modulation counter 13 are initialized. In step S6, various registers used as work registers in an arithmetic process are initialized in the RAM 12. Note that an interval of the interruption timer set in step S4 defines the number of duty cycles of the signal PWM within this interval (see FIG. 7).

Figure 6B:
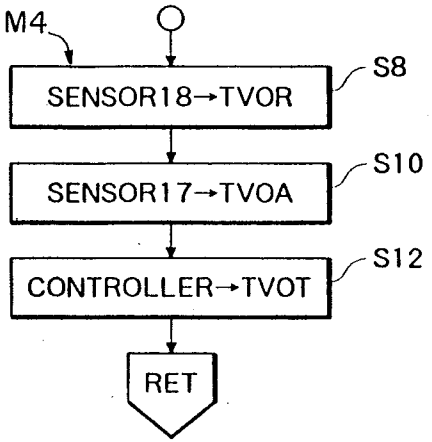

The sampling subroutine will be described below with reference to FIG. 6B. In step S8, a signal indicating an actual opening of the throttle valve 1 from the position sensor 18 is converted to digital data by the A/D converter 10, and the digital data is stored in a register TVOR. In step S10, an angular position signal of the motor 3 from the position sensor 17 is converted to digital data by the A/D converter 10, and the digital data is stored in a register TVOA. In step S12, a target opening signal of the throttle valve from the controller 4 is converted to digital data by the A/D converter 10, and the digital data is stored in a register TVOT. Thus, all the three analog signals are A/D-converted.

Figure 6C:
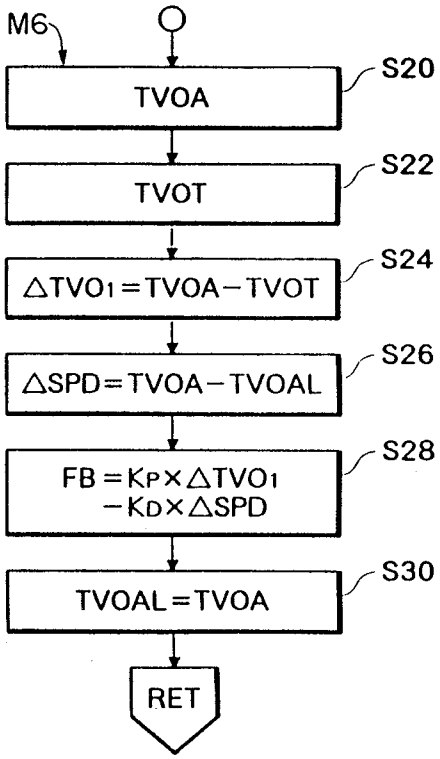

PD control will be described below with reference to FIG. 6C. In steps S20 and S22, the signal values TVOA and TVOT are fetched from the RAM 12. In step S24, a difference $\Delta TVO_1$ between the rotational angular position TVOA of the motor 3 and the target opening TVOT is calculated according to the following equation:

$$\Delta TVO_1 = TVOA - TVOT$$

The difference $\Delta TVO_1$ serves as a proportional control term. In step S26, a held value TVOAL of the rotational angular position TVOA of the motor 3 obtained in the immediately preceding cycle is subtracted from a value TVOA of the present cycle to calculate a rotational speed $\Delta SPD$ of the motor 3.

$$\Delta SPD = TVOA - TVOAL$$

The speed $\Delta SPD$ serves as a derivative control term. In step S28, the motor current value FB is calculated according to the following equation:

$$FB = K_P \times \Delta TVO_1 - K_D \times \Delta SPD$$

where $K_P$ and $K_D$ are the constants for converting the proportional and derivative terms into a motor current value. "$K_P \times \Delta TVO_1$" immediately serves to reduce the difference $\Delta TVO_1$. The derivative term $\Delta SPD$ is the time differential value of the rotational angular position TVOA of the motor 3. Therefore, "$K_D \times \Delta SPD$" serves as a speed correction term when the throttle opening is converged to the target opening TVOT, and serves to prevent the rotational speed of the motor 3 from being varied largely.

In step S30, the TVOAL is updated by the present TVOA for the next control cycle.

Figure 6E:
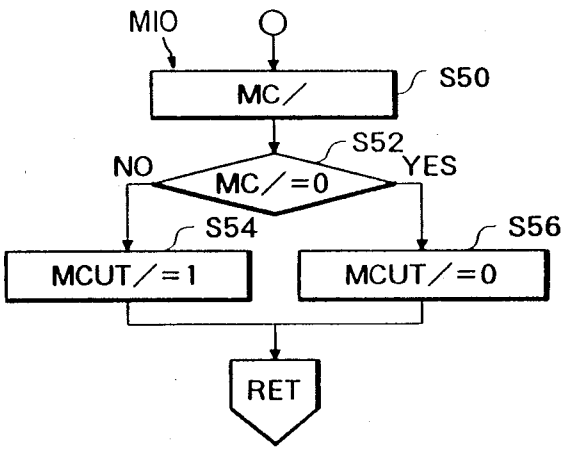
Figure 6D:
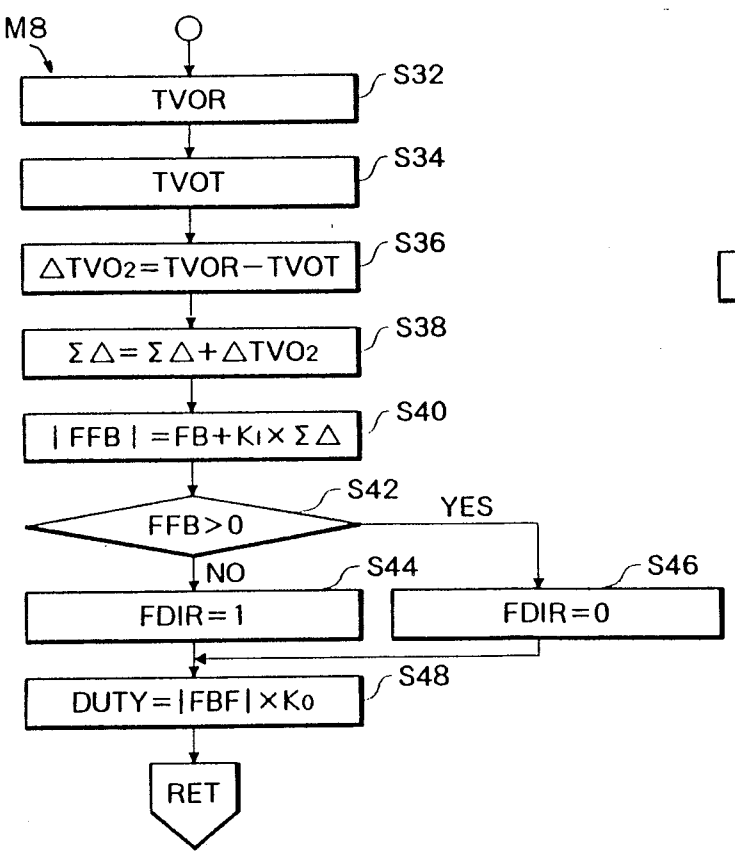

The I control subroutine will be described below with reference to FIG. 6D. In steps S32 and S34, the actual throttle opening TVOR and the target throttle opening TVOT are fetched from the RAM 12. In step S36, a difference $\Delta TVO_2$ between the TVOR and TVOT is calculated:

$$\Delta TVO_2 = TVOR - TVOT$$

In step S38, an integral value $\Sigma\Delta$ of the difference $\Delta TVO_2$ is calculated and updated:

$$\Sigma\Delta = \Sigma\Delta + TVO_2$$

In step S40, the final current value FFB is calculated according to the following equation:

$$FFB = FB + K_I \times \Sigma\Delta$$

where $K_I$ is the constant for converting the integral value $\Sigma\Delta$ into a current value. In the above equation, the current value FB obtained by PD control is corrected by the current value $K_I \times \Sigma\Delta$ obtained by the I control. FB is the current value obtained by the PD control so that the motor rotational angular position is quickly converged to the target throttle opening TVOT and a variation in the rotational speed of the motor is suppressed. Since the value TVOA initially used in the PD arithmetic operation is obtained by directly measuring the rotational angular position of the motor, it does not include the influence of a disturbance caused by the wire. Therefore, the control gains $K_D$ and $K_P$ can be set to be high. More specifically, the value FB is the current value suitable for converging the rotational angular position to the value TVOT at high speed with good response characteristics. Meanwhile, since "$K_I \times \Sigma\Delta$" is the control amount calculated by integral control using the throttle opening TVOR, even if oscillation caused by the wire appears in the throttle valve, it is averaged, and its influence disappears. Since the value TVOR is the actual throttle opening, "$K_I \times \Sigma\Delta$" serves to accurately converge the opening itself of the throttle valve 1 to the target value TVOT although response characteristics are not so good. Therefore, the final current value FFB serves as a control valve most suitable for accurately converging the opening of the throttle valve 1 to the target opening TVOT at high speed while preventing resonance.

In step S42, the rotational direction of the motor 3 (current direction) is determined on the basis of the sign of the calculated current value FFB. In accordance with the determination result, the current direction is stored in a flag FDIR in step S44 or S46. FDIR=1 represents a throttle closing direction, and FDIR=0 represents a throttle opening direction. In step S48, the current value FFB is converted to a duty ratio in accordance with the following equation:

$$DUTY = |FFB| \times K_O$$

where $K_O$ is the predetermined constant for converting the current value to the duty ratio. The duty ratio is determined as a ratio of "1"s and "0"s in one duty cycle so that a current flowing through the motor in a unit time becomes FFB.

Cut control of the motor current will be described below with reference to FIG. 6E. In step S50, the signal MC/ from the throttle controller 4 is fetched through an input port. When the signal MC/ is at LOW level, this means that the motor current is to be cut. Therefore, an output port of the signal MCUT/ is set at LOW level. On the other hand, if it is determined in step S52 that MC/=1, since the motor 3 can be energized, the output port is set at HIGH level (MCUT/=1).

FIG. 5 shows the timer interruption processing routine. In this routine, actual energization to the motor 3 is started. This interruption processing is started at predetermined time intervals (1 to 2 ms). In step S60, preset data (TINT=1 to 2 ms) of a preset interruption processing period is fetched from the RAM 12. In step S62, the fetched data is set in an internal timer (not shown) of the CPU 9. In step S64, the data DUTY calculated in step S48 is fetched, and in step S66, the data DUTY is set in the counter 13 through a data bus. In step S68, the current direction flag FDIR set in step S44 or S46 is checked, and a DIR port (not shown) of the CPU 9 is set at LOW or HIGH level in step S70 or S72. In this manner, the signal PWM obtained by pulse-width modulating the data DUTY is output from the counter 13, and outputs the signals MCUT/ and DIR are output from an internal port of the CPU. As a result, the motor 3 is rotated in the forward or reverse direction in accordance with the value DIR.

Since the routine shown in FIG. 5 is not started until the next timer interruption occurs, even if the value DUTY is updated in the I control arithmetic subroutine, the duty ratio of the signal PWM is not updated until the next interruption. However, as described above, since the counter 13 can be preset without going through the CPU 9, its output signal PWM becomes a pulse signal having a period of 64 μs and a duty ratio defined by the data DUTY, as shown in FIG. 7.

The operation of the engine control apparatus according to the first embodiment has been described.

Second Embodiment

Figure 8:
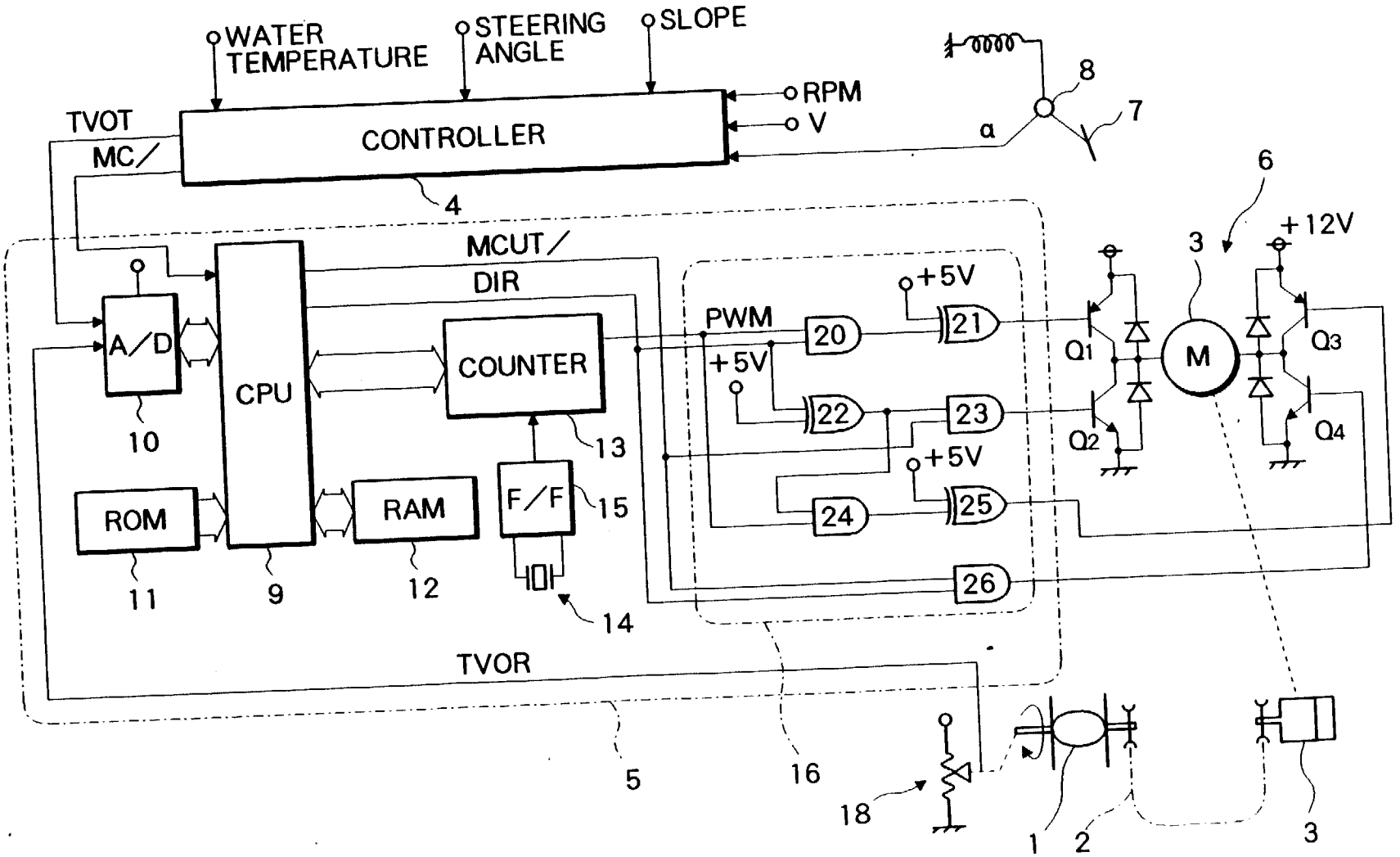
FIG. 8 is a block diagram showing a hardware arrangement of the second embodiment.

FIG. 8 shows a detailed hardware arrangement of a control apparatus according to the second embodiment, which has been schematically described above with reference to FIG. 1B. As can be understood from a comparison between FIGS. 2 and 8, the hardware arrangement of the second embodiment is substantially the same as that of the first embodiment, except that the sensor 17 is omitted from the first embodiment. As has been described in the first embodiment, the sensor 17 is arranged to obtain position data TVOA which is not influenced by the wire and includes less disturbance. For this reason, in the first embodiment, generation of resonance itself is prevented, and whether or not resonance occurs need not be determined. On the other hand, the sensor 18 measures the opening TVOR of the throttle valve 1 connected to the motor 3 through the wire 2. If feedback control is performed simply depending on the actual throttle opening TVOR, the throttle valve 1 is inevitably resonanted. In the second embodiment, generation of resonance is discriminated. If generation of resonance is detected, control characteristics are changed in a direction of eliminating the resonance, so that oscillation of the throttle valve 1 is suppressed to a practical level. Note that in the second embodiment, generation of resonance of the throttle valve 1 is indirectly performed on the basis of the amplitude and period of a variation in control amount DUTY.

Figure 9:
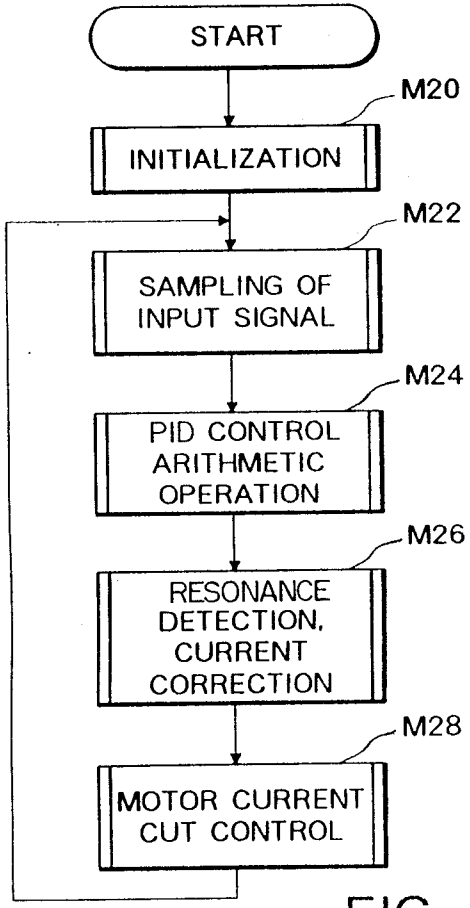
FIG. 9 is a flow chart associated with a main routine portion of a control sequence of the second embodiment.

The elements constituting the second embodiment shown in FIG. 8 are the same as that of the first embodiment, except that the sensor 17 is omitted, and the programs stored in the ROM 11 have the control sequence shown in FIG. 9 and the subsequent figures unlike in the first embodiment. Thus, the same reference numerals in FIG. 8 denote the same constituting elements as in FIG. 2.

FIG. 9 is a flow chart of a main routine portion of the control sequence according to the second embodiment. As can be seen from FIGS. 9 and 1B, feedback control of the second embodiment is achieved by superposing proportional control, integral control, and derivative control performed in a PID control arithmetic subroutine (step M24 in FIG. 9). In the second embodiment, a subroutine (step M26 in FIG. 9) of detecting a resonance state and correcting a motor current when the resonance state is detected is added.

The subroutines of the second embodiment will be described below.

Figure 11B:
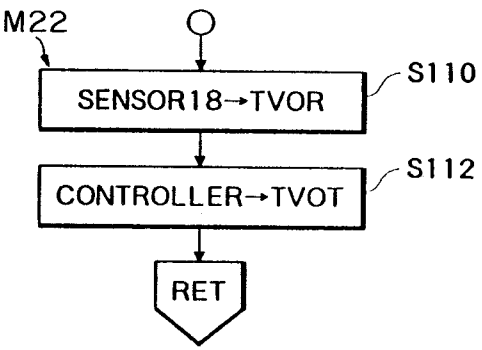
FIGS. 11A through 11E are detailed flow charts of subroutines of the second embodiment.
Figure 11A:
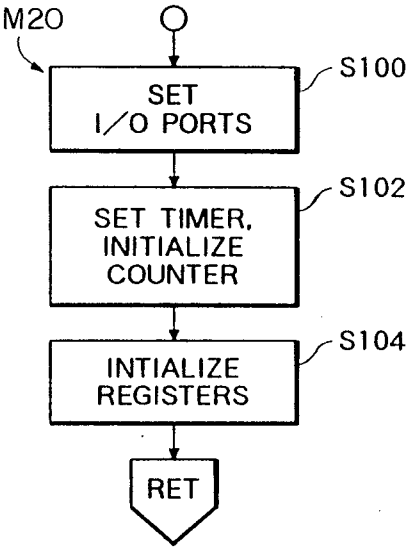
Figure 11C:
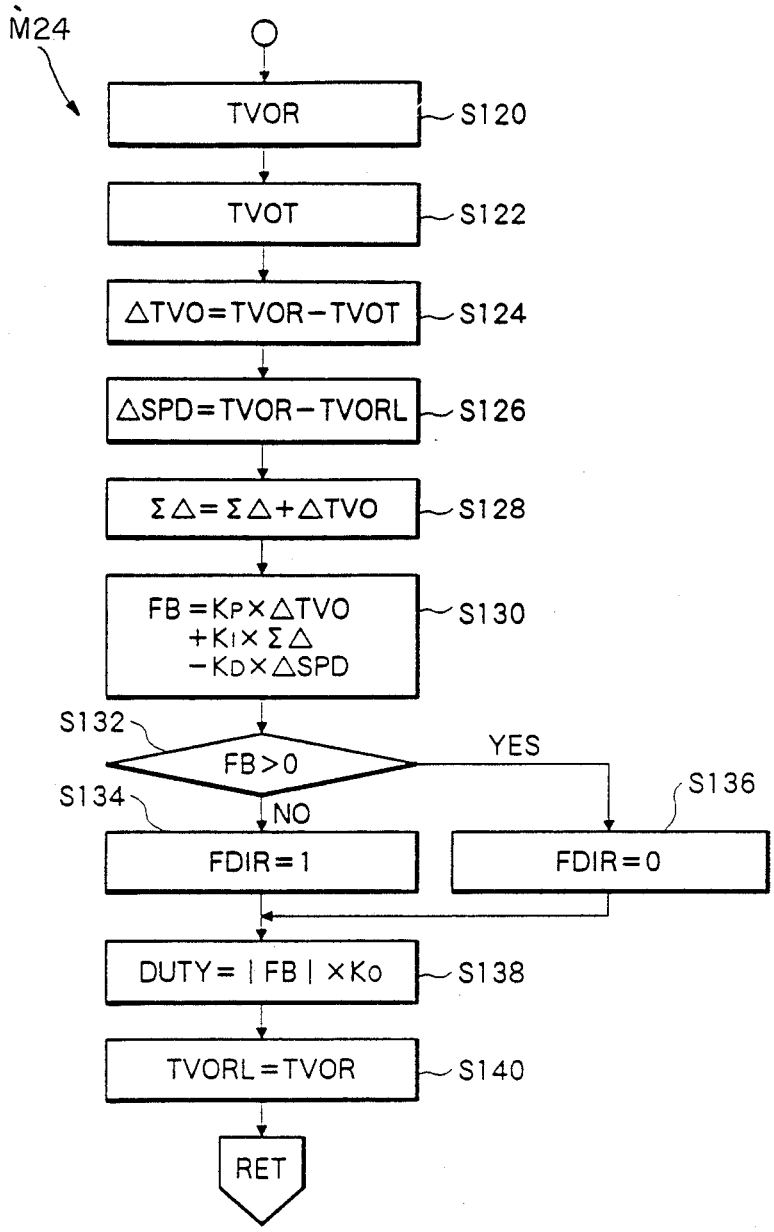

FIG. 11A shows the initialization subroutine in step M20 in detail, and this sequence is substantially the same as that in the first embodiment (FIG. 6A). FIG. 11B shows the sampling routine in step M22 in detail. Referring to FIG. 11B, in step S110, an actual throttle opening signal TVOR from the sensor 18 is converted to digital data, and the digital data is fetched. In step S112, a target throttle opening TVOT is converted to digital data, and is fetched. These input data TVOR and TVOT are transferred to the subsequent PID control arithmetic subroutine. FIG. 11C shows the PID control arithmetic subroutine in detail. In steps S120 and S122, the digital data values TVOR and TVOT are fetched from the RAM 12. In step S124, a difference ΔTVO between the position TVOR and the target opening TVOR of the throttle valve 1 is calculated as follows:

$$\Delta TVO = TVOR - TVOT$$

The difference ΔTVO serves as a proportional control term. In step S126, a held value of the throttle opening TVOR obtained in the immediately preceding cycle is subtracted from a value TVOR in the present cycle to calculate a speed ΔSPD of the motor 3.

$$\Delta SPD = TVOR - TVORL$$

The speed ΔSPD serves as a derivative control term. In step S128, an integral term ΣΔTVO is calculated according to the following equation:

$$\Sigma\Delta = \Sigma\Delta + TVO$$

In step S130, the motor current value FB is calculated according to the following equation:

$$FB = K_P \times \Delta TVO + K_I \times \Sigma\Delta - K_D \times \Delta SPD$$

These constants $K_P$, $K_I$, and $K_D$ have substantially the same meanings as those in the first embodiment, but take different values. In the above equation, "$K_P \times \Delta TVO$" serves to immediately reduce the difference ΔTVO. Even if the throttle valve 1 is oscillated due to a disturbance from the wire 2, its influence is minimized by integration. As a result, "$K_I \times \Sigma\Delta$" serves to improve accuracy of a current flowing through the motor 3. "$K_D \times \Delta SPD$" serves as a speed correction term when the throttle opening is converged to the target opening TVOT, and serves to prevent the rotational speed of the motor 3 from being largely varied. Therefore, the amount FB is a current value for driving the motor 3 so that the opening of the throttle valve 1 is accurately converged to the target value TVOT with good response characteristics unless the throttle valve 1 is in the resonance state.

In steps S132, S134, and S136, a current direction is held in a flag FDIR on the basis of the sign of the amount FB. In step S138, the current value FB is converted to a duty ratio according to the following equation:

$$DUTY = |FB| \times K_O$$

In step S140, the value TVORL is updated by the present value TVOR for the next control cycle. In this manner, the control amount DUTY representing a motor current calculated based on the PID control is obtained. The control amount DUTY is transferred to the next resonance detection current correction subroutine.

Figure 11D:
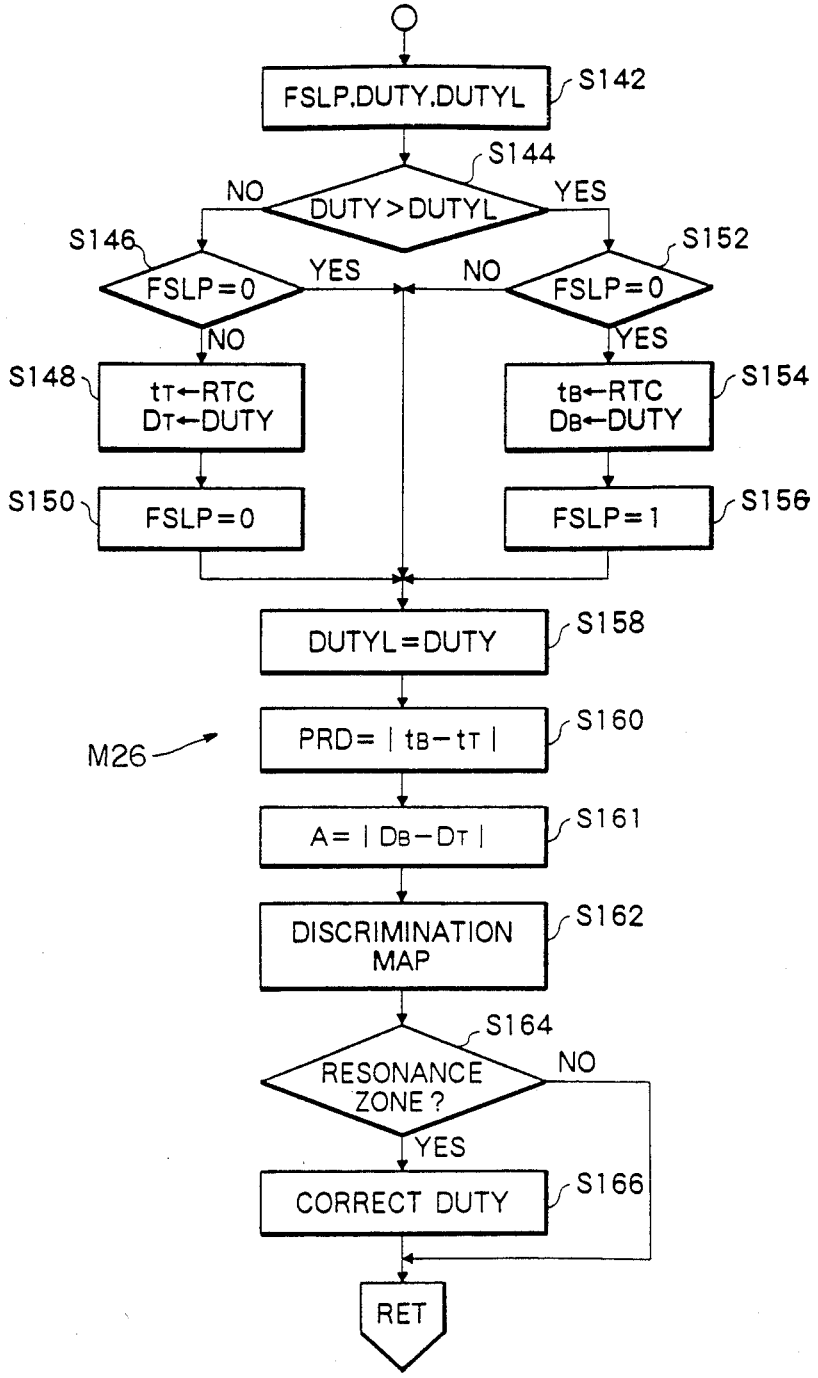

FIG. 11D shows the resonance detection current correction subroutine in step M26 in detail.

In step S142, a flag FSLP, the present duty value DUTY calculated in step S138, and the immediately preceding duty value DUTYL are fetched from the RAM 12. The flag FSLP is a flag for storing the absolute value |FB| of the motor current, i.e., whether the duty value DUTY has an increasing or decreasing tendency. If FSLP=0, this means that the current tends to decrease in the immediately preceding control cycle. If FSLP=1, this means that the current tends to increase.

In steps S144 to S158, a peak of a change in DUTY representing the absolute value of the motor current is detected, and its time and peak value are held. Detection of the peak time and peak value and checking of the period and amplitude of the current value DUTY are necessary for discriminating generation of a resonance state.

In step S144, the values DUTY and DUTYL are compared to determine a present motor current direction.

If it is determined that DUTY>DUTYL, this means that the motor current is increasing, and control advances to step S152. In step S152, the flag FSLP is checked. If FSLP=0, the flow advances to step S154. In step S154, the value of an internal real-time counter RTC (not shown) of the CPU is fetched in a register $t_B$ as present time. The value DUTY at this time is fetched in a register $D_B$ as a bottom value. Although the current is decreased so far (FSLP=0), since the current is switched to increase (DUTY>DUTYL), the present value corresponds to the bottom of a change in current. In step S156, since the current is switched to increase, the flag FSLP is updated to "1".

Figure 12:
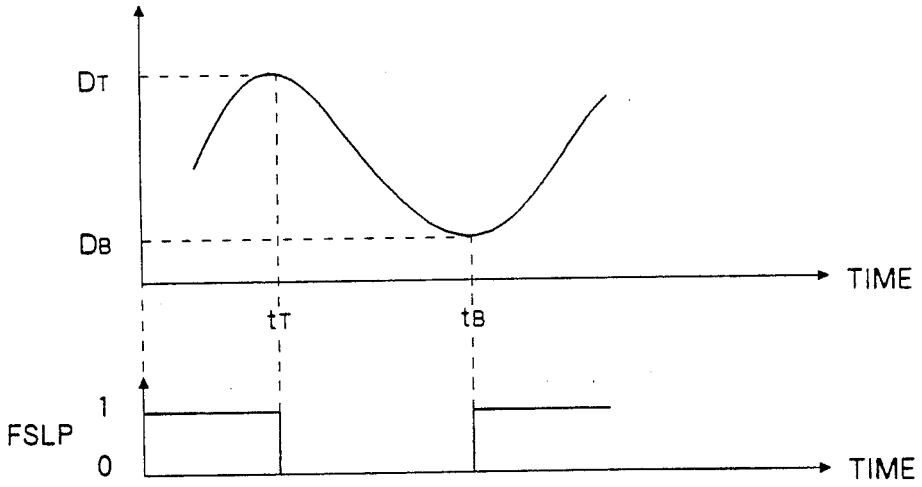
FIG. 12 is a graph for explaining a method of detecting a peak from a variation in signal DUTY.

Similarly, if it is determined in step S144 that DUTY≦DUTYL, and if it is determined in step S146 that FSLP=1, it is determined that the present value corresponds to the peak of a change in current. Therefore, the peak time is stored in a register $t_T$, and a peak T is stored in a register $D_T$. In step S150 in order to store information representing that the current is switched to decrease, the flag FSLP is updated to "0". The above description can be understood with reference to FIG. 12.

In step S158, the value DUTYL is updated.

In step S160, in order to obtain a period PRD of a change in motor current DUTY, the following calculation is performed:

$$PRD = |t_B - t_T|$$

Note that upon measurement by the present inventor, a change frequency of the current DUTY was 5 to 20 Hz. In step S161, in order to obtain an amplitude A of the motor current DUTY, the following calculation is performed:

$$A = |D_B - D_T|$$

In steps S162 and S164, it is discriminated based on the obtained period PRD and the amplitude A whether or not the control system is resonanted. This discrimination is performed as follows. A map shown in FIG. 13, which can be accessed using the values PRD and A as an address is prepared in advance in the ROM 11, and data "1" is stored in a bit of an area in the map, which is considered as resonance. The value in the map is read out in accordance with the values PRD and A obtained in steps S160 and S162, and if the readout map value is "1", it is determined that the throttle valve 1 is in the resonance state.

If the resonance state is determined in step S164, the motor current DUTY is corrected to fall outside a resonance zone in step S166. More specifically, the following correction is made. If the peak of a change in DUTY has been detected just before the present time, the current DUTY is corrected as follows:

$$DUTY = DUTY - \delta$$

where $\delta$ is the positive constant. If the bottom of a change in DUTY has been detected just before the present time, the current DUTY is corrected as follows:

$$DUTY = DUTY + \delta$$

Such a correction is essentially equivalent to correction of the P control constant $K_P$. With this correction, the motor current DUTY is corrected in a direction of reducing the amplitude of its change, and hence, resonance is suppressed. Note that if the period of the change in motor current DUTY is changed in order to suppress the resonance, the integral control constant $K_I$ can be corrected to a smaller value. If the constant $K_I$ is corrected in this manner, the period of throttle oscillation is prolonged, and the resonance state is substantially suppressed.

In this manner, the value DUTY as a duty ratio expression of the motor current is finally obtained. The value DUTY is transferred to the interruption subroutine (FIG. 10), and a current flows through the motor in this subroutine. Since the value DUTY is obtained by PID control, it serves to accurately and immediately converge the throttle valve 1 toward the target throttle opening TVOT. In addition, the value DUTY can suppress resonance of the throttle valve 1 to a practical level.

Figure 10:
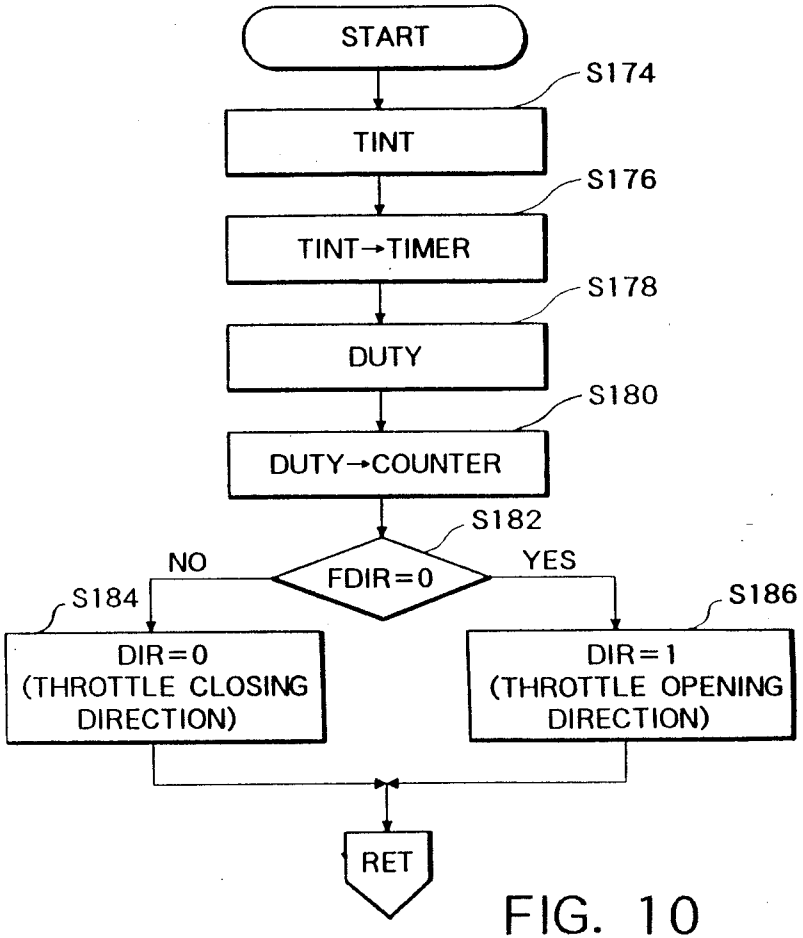
FIG. 10 is a flow chart of an interruption control portion of the control sequence of the second embodiment.
Figure 11E:
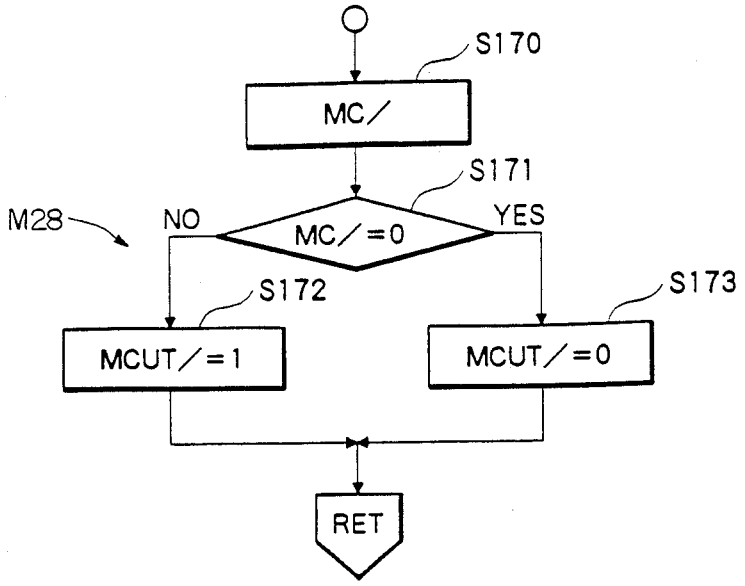

Note that the interruption control routine shown in FIG. 10, the initialization subroutine shown in FIG. 11A, and the motor current cut subroutine shown in FIG. 11E are substantially the same as those in the first embodiment.

Modification

Various modifications of the present invention may be made within the spirit and scope of the invention.

For example, in both the first and second embodiments, feedback control is attained by superposing P control, D control, and I control. For example, the feedback control may be performed while omitting the D control.

In the second embodiment, the resonance state is determined on the basis of the period and amplitude of the value DUTY, i.e., the control amount of the feedback control system. For example, the resonance state can be determined by directly detecting a variation in opening of the throttle valve 1.

In the second embodiment, the actual throttle opening TVOR is used as a sampling signal for the feedback control. Instead, as shown in FIG. 14, a rotational angular position signal TVOA of the motor 3 may be used. In this case, since the motor 3 is not easily influenced by the disturbance caused by the wire 2, a variation in control amount (e.g., DUTY) of the feedback control system becomes small. That is, the amplitude of the variation becomes small. In order to discriminate based on the small variation whether or not the throttle valve 1 is resonated, the map used for discriminating a resonance zone must be replaced with one having higher accuracy than that in the second embodiment (FIG. 13). If the throttle valve 1 is resonated, the resonance is transmitted through the wire 1 and appears in the motor as a change in load. Thus, the change is reflected in a variation in control amount. Therefore, if the resonance discrimination map having high accuracy is used, the resonance state can be accurately detected. As an advantage of using the rotational angular position signal TVOA of the motor 3 as the sampling signal for the feedback control, since the influence of the disturbance to the input signal for the feedback control can be minimized, control accuracy can be improved.

In the second embodiment, as a correction method of DUTY when the resonance state is detected, the proportional constant $K_P$ is corrected. FIG. 15 is a flow chart showing a control sequence of a method of correcting the integral control constant $K_I$.

The present invention is not limited to throttle valve control, and can be applied to throttle control of an engine using various other output adjusting members.

As many apparently widely different embodiments of the present invention can be made without departing from the spirit and scope thereof, it is to be understood that the invention is not limited to the specific embodiments thereof except as defined in the appended claims.

What is claimed is:

1. An engine control apparatus comprising:

(a) an output adjusting member for adjusting an engine output, said output adjusting member being fixed so as to vibrate in accordance with an engine vibration;

(b) an actuator for driving said output adjusting member, said actuator being fixed independently and separately from the engine vibration;

(c) a linkage wire for mechanically connecting said output adjusting member and actuator;

(d) signal detection means for detecting a signal associated with a present drive position of said output adjusting member;

(e) conversion means for converting an accelerator operation amount into a signal associated with a target position of said output adjusting member;

(f) vibration detecting means for detecting the vibration of said present driving position, said vibration being caused by the engine vibration propagated to said output adjusting member through said linkage wire; and (g) feedback control means, connected to said conversion means, signal detection means and vibration detection means, for receiving the signal associated with the present drive position and the signal associated with the target portion, calculating a feedback control signal on the basis of the signals so that said control signal may suppress the vibration of said output adjusting member, and outputting the control signal to said actuator so as to move said output adjusting member to the target position.

2. An engine control apparatus having an output adjusting member for adjusting an engine output and an actuator for driving said output adjusting member through a wire, comprising:

first position sensor means for detecting an operation position of said actuator;

second position sensor means for detecting an operation position of said output adjusting member;

target position setting means for setting a target position of said output adjusting member;

first arithmetic means for calculating a first control amount on the basis of the output form said first position sensor means and the output from said target position setting means;

second arithmetic means for calculating a second control amount on the basis of the output from said second position sensor means and the output from said target position setting means; and feedback control means for calculating a feedback control amount on the basis of the calculated first and second control amounts and outputting a drive signal corresponding to the feedback control amount to said actuator.

3. An apparatus according to claim 2, wherein said first arithmetic means includes means for comparing the output from said first position sensor means and the output from said target position setting means, and means for calculating a control amount including a proportional amount according to the comparison result.

4. An apparatus according to claim 2, wherein said second arithmetic means includes means for comparing the output form said second position sensor means and the output form said target position setting means, and means for calculating a control amount including an integral amount of the comparison result.

5. An apparatus according to claim 2, wherein said output adjusting member comprises a throttle valve of an engine.

6. An apparatus according to claim 2, wherein said actuator comprises a DC motor which is driven by a DC current corresponding to the drive signal from said feedback control means.

7. An apparatus according to claim 2, wherein said first arithmetic means includes means for comparing the output from said first position sensor means and the output from said target position setting means, and means for calculating a control amount including a proportional amount according to the comparison result, and said second arithmetic means includes means for comparing the output from said second position sensor means and the output from said target position setting means, and means for calculating a control amount including an integral amount of the comparison result.

8. An engine control apparatus having an output adjusting member for adjusting an engine output and an actuator for driving said output adjusting member through a wire, comprising:

signal detection means for detecting a signal associated with a present drive position of said output adjusting member;

conversion means for converting an accelerator operation amount into a signal associated with a target position of said output adjusting member;

feedback control means for receiving the signal associated with the present drive position and the signal associated with the target position, calculating a feedback control signal on the basis of the signals, and outputting the control signal to said actuator so as to move said output adjusting member to the target position;

resonance detection means for detecting a resonance state of said output adjusting member; and control characteristic changing means for, when said resonance detection means detects the resonance state or an oscillation state approximate to the resonance state, changing control characteristics of said feedback control means in a direction of eliminating the resonance.

9. An apparatus according to claim 8, wherein said resonance detection means receives the feedback control signal from said feedback control means, and detects the resonance state on the basis of a frequency and an amplitude of the control signal.

10. An apparatus according to claim 8, wherein said output adjusting member comprises a throttle valve of an engine.

11. An apparatus according to claim 8, wherein said actuator comprises a DC motor which is driven by a DC current corresponding to the drive signal from said feedback control means.

12. An apparatus according to claim 8, wherein said signal detection means includes first position sensor means for directly detecting an operation position of said actuator, and outputs an output from said first position sensor means to said feed back control means as the signal associated with the present drive position of said output adjusting member.

13. An apparatus according to claim 8, wherein said signal detection means includes second position sensor means for directly detecting an operation position of said output adjusting member, and outputs an output from said first position sensor means to said feedback control means as the signal associated with the present drive position of said output adjusting member.

* * * * *

UNITED STATES PATENT AND TRADEMARK OFFICE

CERTIFICATE OF CORRECTION

PATENT NO. : 4,941,444

DATED : July 17, 1990

INVENTOR(S) : Nagahisa FUJITA

It is certified that error appears in the above-identified patent and that said Letters Patent is hereby corrected as shown below:

In the drawings:
Add Figs. 2, 3, 7 and 8, as shown on the attached pages.

Signed and Sealed this

Seventh Day of January, 1992

*Attest:*

HARRY F. MANBECK, JR.

*Attesting Officer*

*Commissioner of Patents and Trademarks*

| STATE / SIGNAL | 0 | 1 | 2 | 3 | 4 | 5 | 6 | 7 |
|---|---|---|---|---|---|---|---|---|
| PWM | 0 | 0 | 0 | 0 | 1 | 1 | 1 | 1 |
| DIR | 0 | 0 | 1 | 1 | 0 | 0 | 1 | 1 |
| MCUT | 0 | 1 | 0 | 1 | 0 | 1 | 0 | 1 |
| $Q_1$ | OFF | OFF | OFF | OFF | OFF | OFF | ON | ON |
| $Q_4$ | OFF | OFF | OFF | OFF | OFF | OFF | OFF | ON |
| $Q_3$ | OFF | OFF | OFF | OFF | ON | ON | OFF | OFF |
| $Q_2$ | OFF | OFF | OFF | OFF | OFF | ON | OFF | OFF |

ENT NO. : 4,941,444